US009627160B1

(12) United States Patent
Rojko et al.

(10) Patent No.: US 9,627,160 B1
(45) Date of Patent: Apr. 18, 2017

(54) SYSTEMS AND METHODS FOR ROTARY KNOB FRICTION ADJUSTMENT CONTROL

(71) Applicant: Siemens Aktiengesellschaft, München (DE)

(72) Inventors: Jan Rojko, Conyers, GA (US); Stephen Scott Thomas, Atlanta, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 15/040,343

(22) Filed: Feb. 10, 2016

(51) Int. Cl.
*H01H 19/00* (2006.01)
*H01H 19/04* (2006.01)
*H01H 19/14* (2006.01)

(52) U.S. Cl.
CPC ..... *H01H 19/04* (2013.01); *H01H 19/14* (2013.01); *H01H 2235/01* (2013.01)

(58) Field of Classification Search
CPC ... H01H 71/56; H01H 3/58; H01H 2071/7481
USPC ..... 200/14, 43.15, 11 R, 38 A, 564; 335/42, 335/171, 176, 274
See application file for complete search history.

(56) References Cited

U.S. PATENT DOCUMENTS 3,831,120 A * 8/1974 Powell ..... H01H 71/74 200/286
4,691,182 A * 9/1987 Mrenna ..... H01H 71/7418 335/176
5,831,501 A * 11/1998 Kolberg ..... H01H 71/7463 335/176
6,667,675 B2 * 12/2003 Gibson ..... H01H 71/7463 335/171
6,956,452 B2 * 10/2005 Kumar ..... H01H 71/7463 335/176
7,592,888 B2 * 9/2009 Colsch ..... H01H 71/74 335/176

* cited by examiner

*Primary Examiner* — Vanessa Girardi

(57) ABSTRACT

A circuit breaker including a trip unit having an internal support and a friction adjustment control system for knob control is provided. The internal support includes a first opening to receive a first rotary knob having one or more first smooth rings and a second opening to receive a second rotary knob having one or more second smooth rings. The trip unit includes a first knob control of the first rotary knob. The first knob control includes a first structural support, a first housing and a first spring installed in the first housing against the first structural support. The trip unit further includes a second knob control of the second rotary knob. The second knob control includes a second structural support, a second housing and a second spring installed in the second housing against the second structural support.

20 Claims, 7 Drawing Sheets

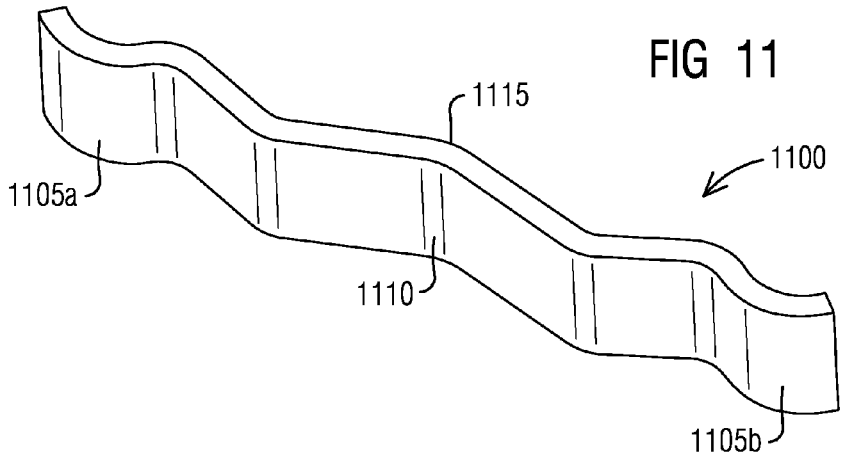
FIG 11
FIG 12
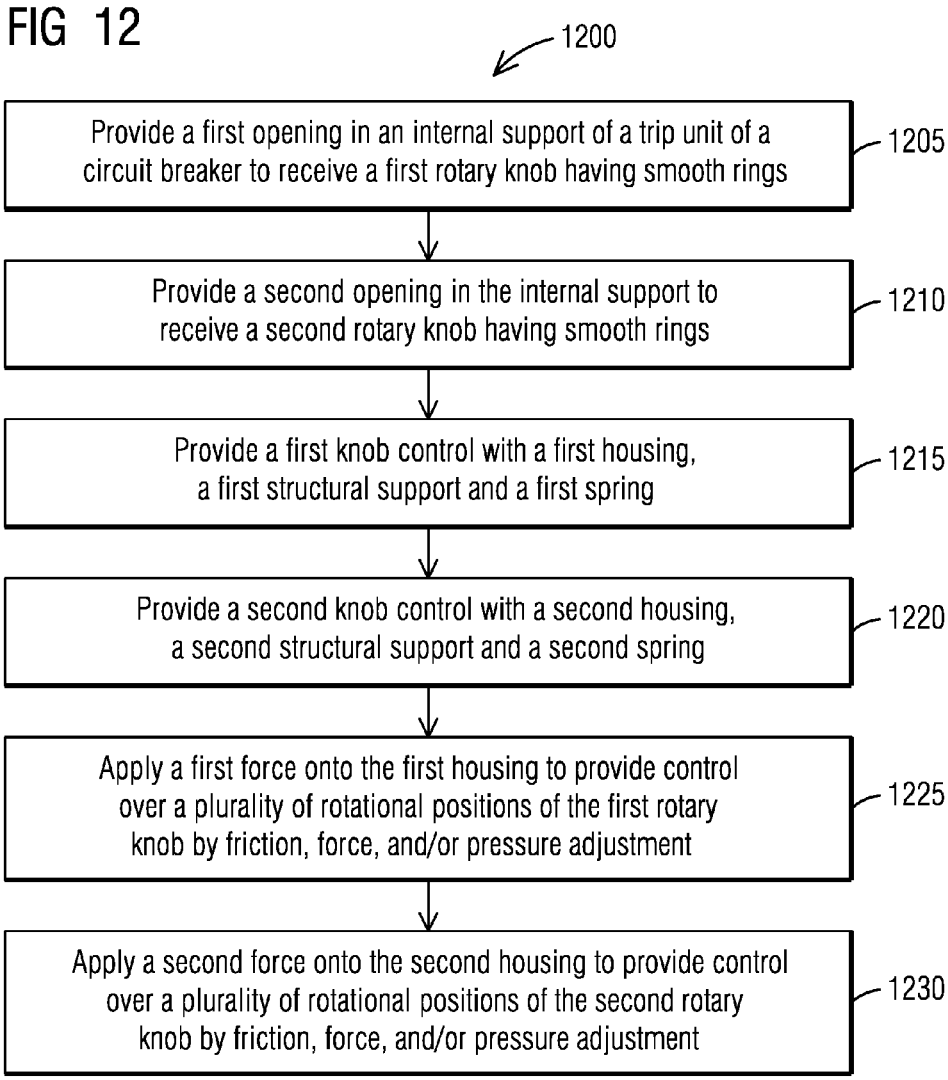

SYSTEMS AND METHODS FOR ROTARY KNOB FRICTION ADJUSTMENT CONTROL

BACKGROUND

1. Field

Aspects of the present invention generally relate to rotary knob friction adjustment control and more specifically relates to controlling rotational positions of knobs in a trip unit of a circuit breaker by friction, force, and/or pressure.

2. Description of the Related Art

Use of rotary knobs to provide a mechanical control of some parameter is well known. This control is enabled by providing finite rotational positions of the knobs. The rotational positions can be controlled by friction, force, and/or pressure. For example, control of rotational positions of knobs may be needed in a trip unit of a circuit breaker.

In the past the trip unit housings have been usually designed as two halves (two structural parts) split right through the centre of rotation of the knobs. These two halves, knobs and flat step operation springs are put together as a blind assembly. Knob control can be done with dents on the knobs. Dents may be crescent-shaped grooves being paired with corresponding plastic flexible fingers snapping in the grove for predetermined rotational knob position. All parts (knobs and housing halves) are usually hard plastic injection molded parts, but tight tolerances are necessary to make such an assembly possible. However, the tight tolerances made assemblies more expensive.

Therefore, there is a need for improvements in rotary knob friction adjustment control for applications such as in a trip unit of a circuit breaker.

SUMMARY

Briefly described, aspects of the present invention relate to a friction adjustment control system configured to continuously control multiple rotational positions of a rotary knob in a trip unit of a circuit breaker by friction, force, and/or pressure. In particular, a spring may be installed in a housing against a structural support to apply a force onto the housing such that the housing presses directly against one or more smooth rings of the rotary knob. The spring may be a coiled spring. Alternatively, a spring may be installed in a pair of slots to apply a force directly against one or more smooth rings of the rotary knob. The spring may be a flat spring having a smooth perimeter. The flat spring can be of a symmetrical or an asymmetrical shape. One of ordinary skill in the art appreciates that such a friction adjustment control system can be configured to be installed in different environments where rotary knob friction adjustment control is needed, for example, in a trip unit of a circuit breaker.

In accordance with one illustrative embodiment of the present invention, a circuit breaker is provided. The circuit breaker comprises a trip unit including an internal support. The internal support includes a first opening to receive a first rotary knob having one or more first smooth rings and a second opening to receive a second rotary knob having one or more second smooth rings. The circuit breaker further comprises a first knob control of the first rotary knob. The first knob control includes a first structural support, a first housing and a first spring installed in the first housing against the first structural support to apply a force onto the first housing such that the first housing presses directly against the one or more first smooth rings of the first rotary knob. The circuit breaker further comprises a second knob control of the second rotary knob. The second knob control includes a second structural support, a second housing and a second spring installed in the second housing against the second structural support to apply a force onto the second housing such that the second housing presses directly against the one or more second smooth rings of the second rotary knob.

In accordance with another illustrative embodiment of the present invention, a circuit breaker is provided. The circuit breaker comprises a trip unit including an internal support. The internal support includes a first opening to receive a first rotary knob having one or more first smooth rings, a second opening to receive a second rotary knob having one or more second smooth rings, a first pair of slots and a second pair of slots. The circuit breaker further comprises a first knob control of the first rotary knob. The first knob control includes a first spring installed in the first pair of slots to apply a force directly against the one or more first smooth rings of the first rotary knob. The circuit breaker comprises a second knob control of the second rotary knob. The second knob control includes a second spring installed in the second pair of slots to apply a force directly against the one or more second smooth rings of the second rotary knob.

In accordance with yet another illustrative embodiment of the present invention, a method of controlling rotational positions of knobs in a thermal magnetic trip unit of a circuit breaker is provided. The method comprises providing a first opening in an internal support of a trip unit to receive a first rotary knob having one or more first smooth rings; providing a second opening in the internal support to receive a second rotary knob having one or more second smooth rings; providing a first knob control of the first rotary knob, the first knob control including a first structural support, a first housing and a first spring installed in the first housing against the first structural support; providing a second knob control of the second rotary knob, the second knob control including a second structural support, a second housing and a second spring installed in the second housing against the second structural support; applying a first force onto the first housing such that the first housing pushes directly against the one or more first smooth rings of the first rotary knob to provide control over a plurality of rotational positions of the first rotary knob by at least one of friction, force, and pressure adjustment; and applying a second force onto the second housing such that the second housing pushes directly against the one or more second smooth rings of the second rotary knob to provide control over a plurality of rotational positions of the second rotary knob by at least one of friction, force, and pressure adjustment.

BRIEF DESCRIPTION OF THE DRAWINGS

FIG. 11 illustrates an isometric view of a symmetrical flat spring for use in a friction adjustment control system of a rotary knob in accordance with an exemplary embodiment of the present invention.

FIG. 12 illustrates a flow chart of a method of controlling rotational positions of knobs in a thermal magnetic trip unit of a circuit breaker in accordance with an exemplary embodiment of the present invention.

DETAILED DESCRIPTION

To facilitate an understanding of embodiments, principles, and features of the present invention, they are explained hereinafter with reference to implementation in illustrative embodiments. In particular, they are described in the context of being a friction adjustment control system configured to continuously control multiple rotational positions of a rotary knob in a trip unit of a circuit breaker by friction, force, and/or pressure. For example, such a friction adjustment control system may control infinite rotational positions of thermal and magnetic rotary knobs in a Thermal Magnetic Trip Unit (TMTU) continuously by friction, force, and/or pressure in a Molded Case Circuit Breaker (MCCB). Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
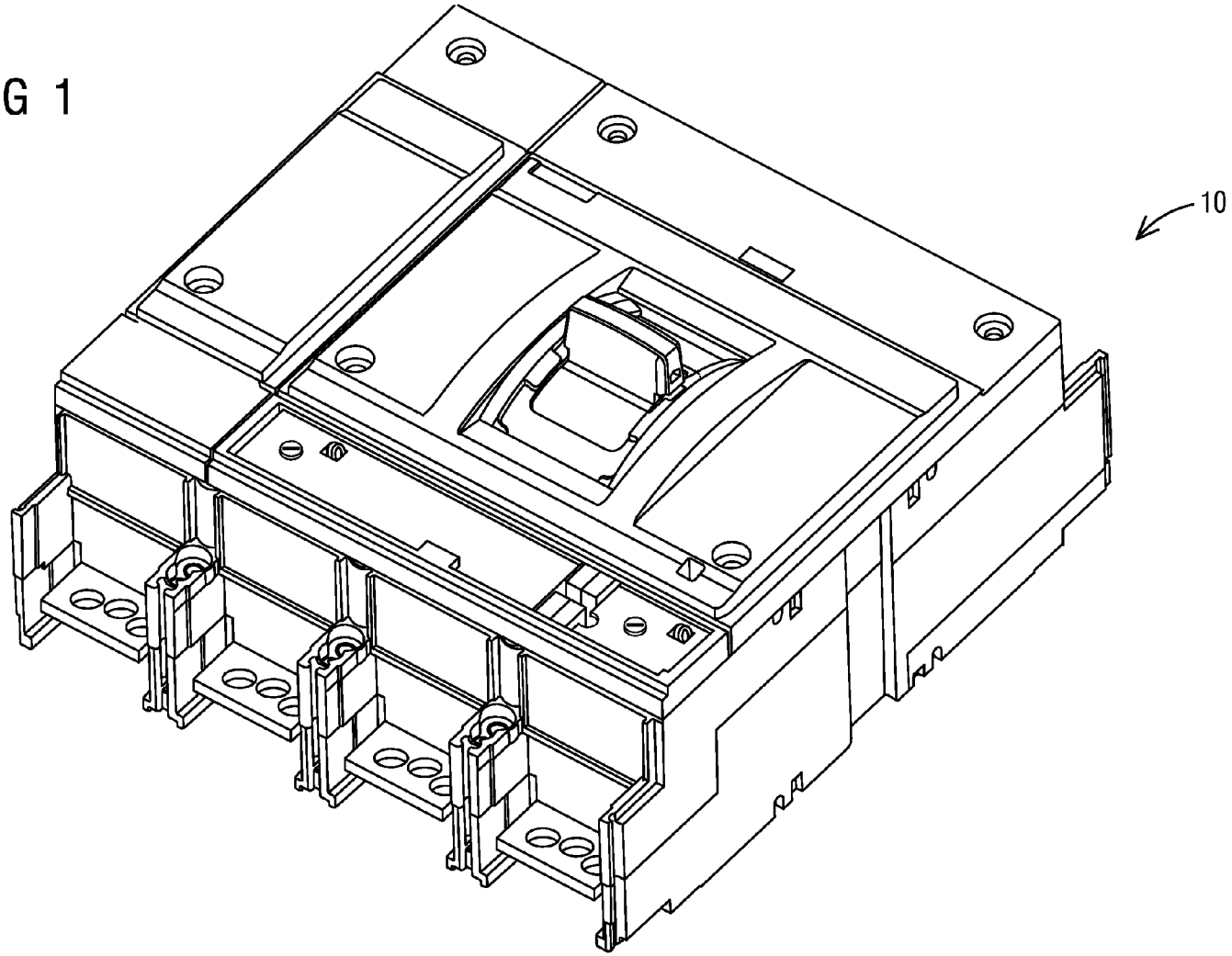
FIG. 1 illustrates an isometric view of a circuit breaker in accordance with an exemplary embodiment of the present invention.

Consistent with one embodiment of the present invention, FIG. 1 represents an isometric view of a circuit breaker 10. Examples of the circuit breaker include Molded Case Circuit Breakers (MCCBs) with current ratings from 3 A to 2000 A and interrupt ratings up to 200 kA at 480V. The circuit breaker 10 may be configured in different frame sizes such as from 125 A to 2000 A. The circuit breaker 10 is for use in individual enclosures, switchboards, panelboards, and load centers. The circuit breaker 10 may include a Thermal Magnetic Trip Unit (TMTU). The Thermal Magnetic Trip Unit (TMTU) may provide complete overload and short circuit protection by use of a time delay thermal trip element and an instantaneous magnetic trip element. The circuit breaker 10 may include a molded case switch having a factory-installed preset instantaneous function to allow the switch to trip at a value over 1000 A and protect itself against high fault conditions. Overload and fault current protection may be provided by separate over-current devices.

In the circuit breaker 10 being a 4-pole circuit breaker, with the mechanism latched and the contacts open, an operating handle will be in the OFF position. Moving the operating handle to the ON position closes the contacts and establishes a circuit through the circuit breaker 10. Under overload or short circuit conditions sufficient to automatically trip or open the circuit breaker 10, the operating handle moves to a position between ON and OFF. To relatch the circuit breaker 10 after automatic operation, the operating handle can be moved to the RESET position. The circuit breaker 10 becomes ready for reclosing. An overcenter toggle mechanism may be trip free of the operating handle. The circuit breaker 10, therefore, cannot be held closed by means of the operating handle should a tripping condition exist. After automatic operation, the operating handle assumes an intermediate position between ON and OFF, thus displaying a clear indication of tripping.

As used herein, the "circuit breaker" refers to a single or multi-pole circuit breaker, as described herein, which corresponds to an automatically operated electrical switch designed to protect an electrical circuit from damage caused by overload or short circuit. Its basic function is to detect a fault condition and interrupt current flow. The "multi-pole circuit breaker," in addition to the exemplary hardware description above, refers to a device that is configured to reset (either manually or automatically) to resume normal operation. The "multi-pole circuit breaker," may be used to protect an individual household appliance up to a large switchgear designed to protect high voltage circuits feeding an entire city, and operated by a controller. It should be appreciated that several other components may be included in the "multi-pole circuit breaker." The "multi-pole circuit breaker," may be capable of operating based on its features such as voltage class, construction type, interrupting type, and structural features.

The techniques described herein can be particularly useful for controlling rotational positions of rotary knobs in a Thermal Magnetic Trip Unit (TMTU) of a Molded Case Circuit Breaker (MCCB). While particular embodiments are described in terms of thermal and magnetic rotary knobs, the techniques described herein are not limited to thermal and magnetic rotary knobs but can also use knobs with other engagement modes, such as sliding knobs.

Figure 2:
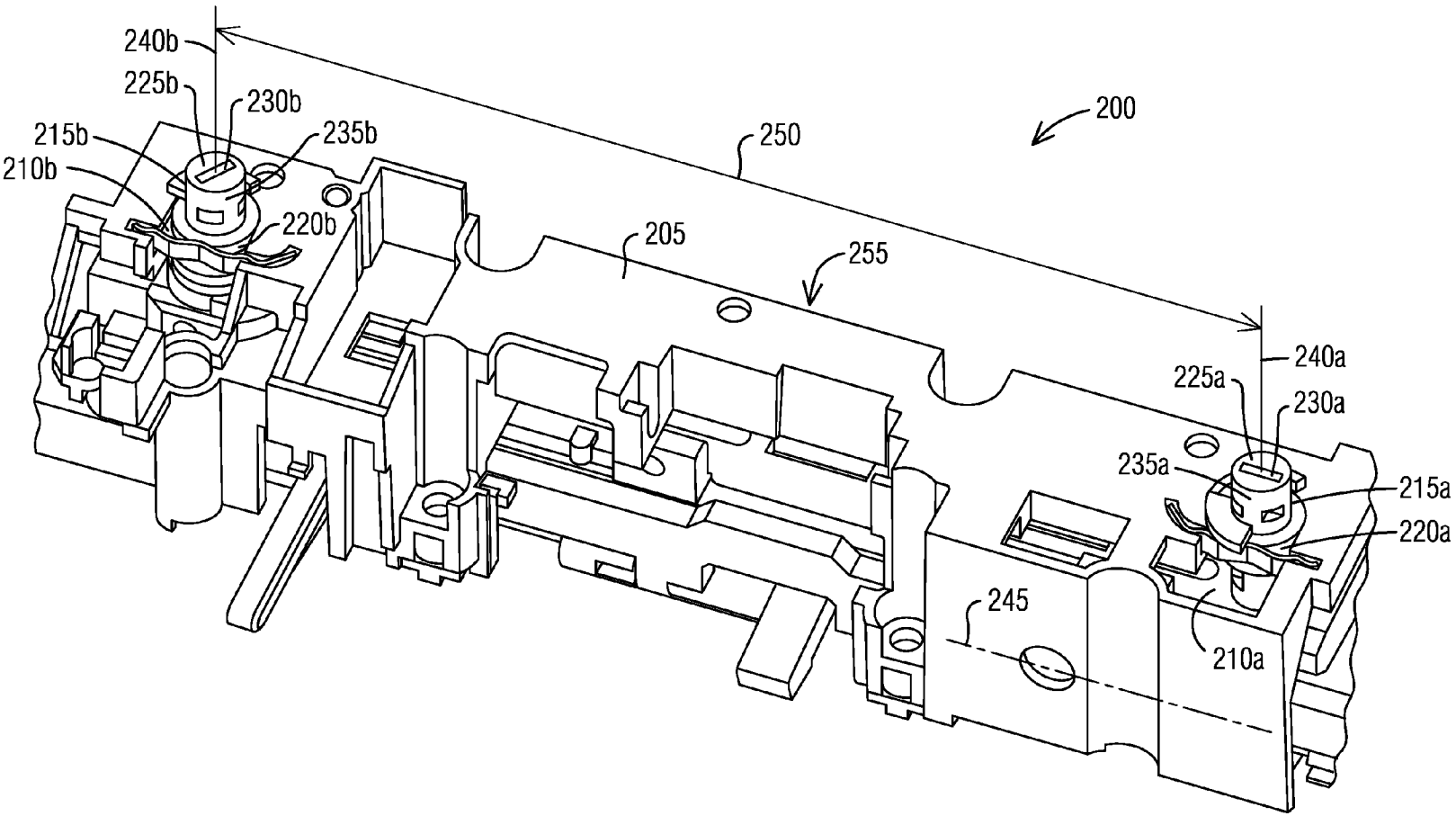
FIG. 2 illustrates an isometric view of a trip unit of the circuit breaker including an internal support in accordance with an exemplary embodiment of the present invention.

Referring to FIG. 2, it illustrates an isometric view of a trip unit 200 of the circuit breaker 10 including an internal support 205 in accordance with an exemplary embodiment of the present invention. The internal support 205 includes a first opening 210*a* to receive a first rotary knob 215*a* having one or more first smooth rings 220*a* and a second opening 210*b* to receive a second rotary knob 215*b* having one or more second smooth rings 220*b*. The first opening 210*a* of the internal support 205 is configured to slidingly receive the first rotary knob 215*a* into position through the first opening 210*a*. Likewise, the second opening 210*b* of the internal support 205 is configured to slidingly receive the second rotary knob 215*b* into position through the second opening 210*b*

In the past the trip unit housings have been usually designed as two halves (two structural parts) split right through the centre of rotation of the knobs. These two halves, knobs and flat step operation springs are put together as a blind assembly. However, the first opening 210*a* and the second opening 210*b* do not require tight tolerances which are otherwise necessary to make a two halve assembly possible. Absent the tight tolerances, the assemblies are relatively made cheaper. The installation process of the first rotary knob 215*a* and the second rotary knob 215*b* in the trip unit 200 also becomes easier. Therefore, maintenance of the trip unit 200 becomes efficient and less cumbersome as compared to two halves design.

The first rotary knob 215*a* and the second rotary knob 215*b* are configured to provide a mechanical control of a corresponding parameter. For example, the first rotary knob 215*a* provides a control over a thermal parameter in the trip unit 200. On the other hand, the second rotary knob 215*b* provides a control over a magnetic parameter in the trip unit 200. This control is enabled by providing continuous infinite rotational positions of the first rotary knob 215*a* and the second rotary knob 215*b*. These rotational positions may be controlled by friction, force, and/or pressure.

The function of the thermal and magnetic knobs in the trip unit 200 is to change the settings or 'Tripping' behavior of the trip unit 200. For example, in a thermal/magnetic type trip unit, the first rotary knob 215*a* (e.g. thermal knob) adjusts the over-current setting which protects from lower level currents typically greater than 1-4× the rating of the circuit breaker 10. The second rotary knob 215*b* (e.g., magnetic knob) adjusts the instantaneous settings which protect from higher level short circuit conditions, current levels typically above 5× rating of the circuit breaker 10. One skilled in the pertinent art would recognize that for electronic type trip units, there are many different trip curves, with various time delays, pickup times, etc.

The first rotary knob 215*a* has a top surface 225*a* having a groove 230*a* and the second rotary knob 215*b* has a top surface 225*b* having a groove 230*b*. Both the grooves 230*a*, 230*b* are shaped to be used with a tool such a flat screw driver to rotate the respective first rotary knob 215*a* and the second rotary knob 215*b*. The first rotary knob 215*a* has a head 235*a* projecting away from the internal support 205 and the second rotary knob 215*b* has a head 235*b* projecting away from the internal support 205. The groove 230*a* is situated at the distal end of the head 235*a*. Likewise, the groove 230*b* is situated at the distal end of the head 235*b*.

The first rotary knob 215*a* has an axis of rotation 240*a* perpendicular to a longitudinal axis 245 of the internal support 205 and the second rotary knob 215*b* has an axis of rotation 240*b* perpendicular to the longitudinal axis 245 of the internal support 205. Both the first rotary knob 215*a* and the second rotary knob 215*b* are aligned in a straight line on the longitudinal axis 245 of the internal support 205 and separated by a longitudinal distance 250. Both the first rotary knob 215*a* and the second rotary knob 215*b* are aligned to operate on a same plane 255.

In one embodiment, while the first rotary knob 215*a* is a thermal knob of a molded case circuit breaker (MCCB), the second rotary knob 215*b* is a magnetic knob of the molded case circuit breaker (MCCB) The trip unit 200 is a thermal magnetic trip unit of the molded case circuit breaker (MCCB).

Consistent with one embodiment, the internal support 205, the first rotary knob 215*a*, the second rotary knob 215*b* may be made of hard plastic via an injection molding process. However, the function and use of such equipment for injection molding circuit breaker parts are well known in the art and are not discussed further.

Figure 3:
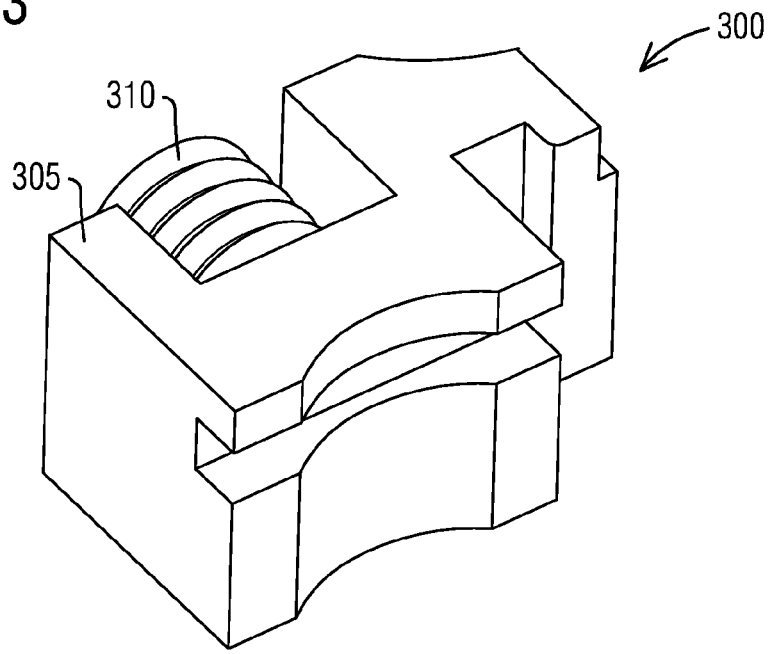
FIG. 3 illustrates an isometric view of a back side view of a knob control system in accordance with an exemplary embodiment of the present invention.

Turning now to FIG. 3, it illustrates an isometric view of a back side view of a knob control system 300 in accordance with an exemplary embodiment of the present invention. The knob control system 300 includes a first housing 305 and a first spring 310 installed in the first housing 305. The first housing 305 is configured to press directly against the one or more first smooth rings 220*a* of the first rotary knob 215*a*.

Examples of the first spring 310 include a coiled spring. The coiled spring may be made of music wire, zinc plated music wire or a stainless steel. The coiled spring wire diameter may range from 0.6 mm to over 1.0 mm. The coiled spring force may range from 15N to over 50N.

Figure 4:
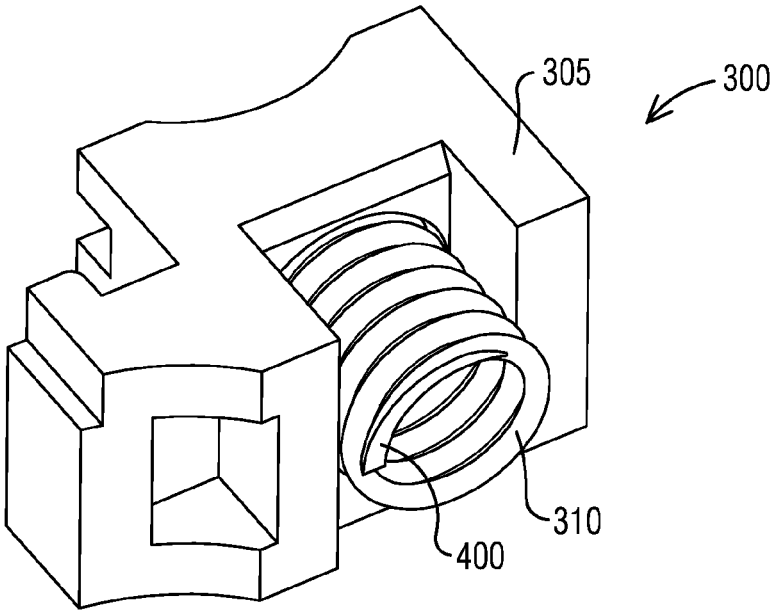
FIG. 4 illustrates an isometric view of a front side view of the knob control system of FIG. 3 in accordance with an exemplary embodiment of the present invention.

FIG. 4 illustrates an isometric view of a front side view of the knob control system 300 of FIG. 3 in accordance with an exemplary embodiment of the present invention. The first spring 310 may include a flat surface 400 at the end of a coil of the first spring 310.

Figure 5:
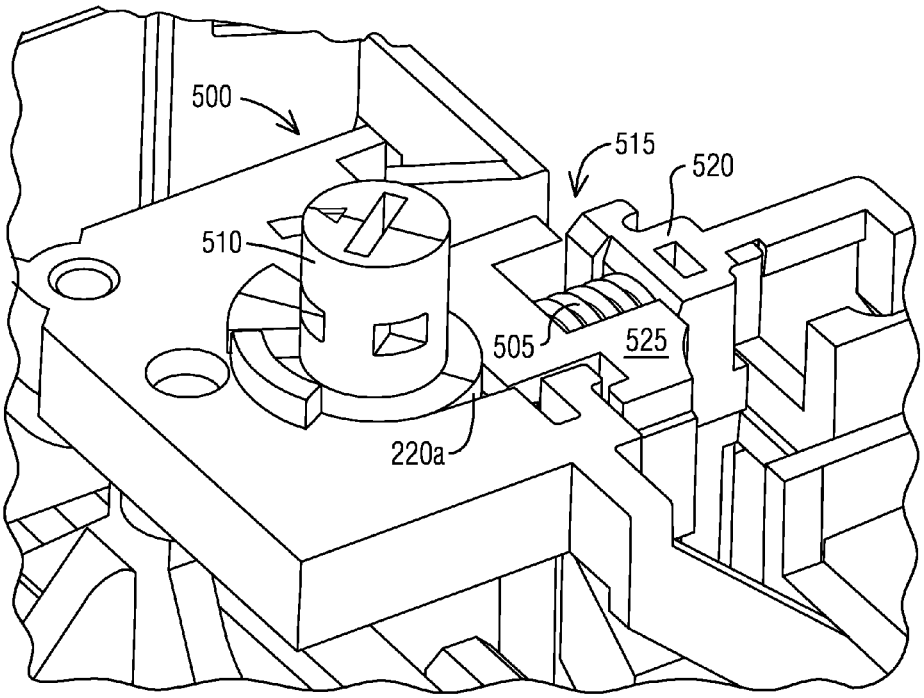
FIG. 5 illustrates an isometric view of a friction adjustment control system with a coiled spring for a magnetic rotary knob in accordance with an exemplary embodiment of the present invention.

As shown in FIG. 5, it illustrates an isometric view of a friction adjustment control system 500 with a coiled spring 505 for a magnetic rotary knob 510 in accordance with an exemplary embodiment of the present invention. The friction adjustment control system 500 includes a first knob control 515 of the magnetic rotary knob 510. The first knob control 515 includes a first structural support 520, a first housing 525 and the coiled spring 505 installed in the first housing 525 against the first structural support 520 to apply a force onto the first housing 525 such that the first housing 525 presses directly against the one or more first smooth rings 220*a* of the magnetic rotary knob 510. The first structural support 520 is a part of the internal support 205. The one or more first smooth rings 220*a* has a shaped surface that provides control over a plurality of rotational positions of the magnetic rotary knob 510 continuously by friction, force, and/or pressure adjustment.

Figure 6:
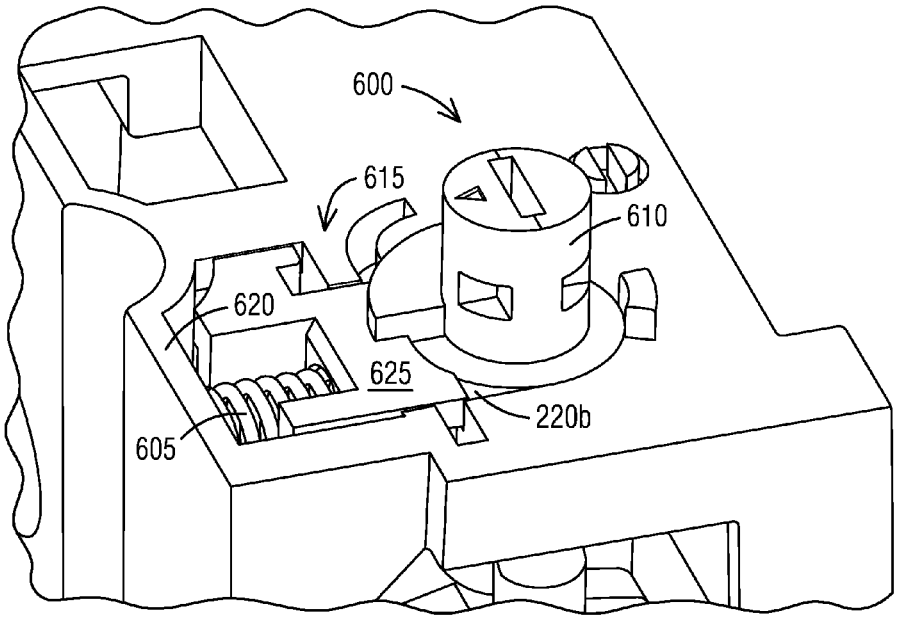
FIG. 6 illustrates an isometric view of a friction adjustment control system with a coiled spring for a thermal rotary knob in accordance with an exemplary embodiment of the present invention.

As seen in FIG. 6, it illustrates an isometric view of a friction adjustment control system 600 with a coiled spring 605 for a thermal rotary knob 610 in accordance with an exemplary embodiment of the present invention. The friction adjustment control system 600 includes a second knob control 615 of the thermal rotary knob 610. The second knob control 615 includes a second structural support 620, a second housing 625 and the coiled spring 605 installed in the second housing 625 against the second structural support 620 to apply a force onto the second housing 625 such that the second housing 625 presses directly against the one or more second smooth rings 220*b* of the thermal rotary knob 610. The one or more second smooth rings 220*b* has a shaped surface that provides control over a plurality of rotational positions of the thermal rotary knob 610 continuously by friction, force, and/or pressure adjustment.

Figure 7:
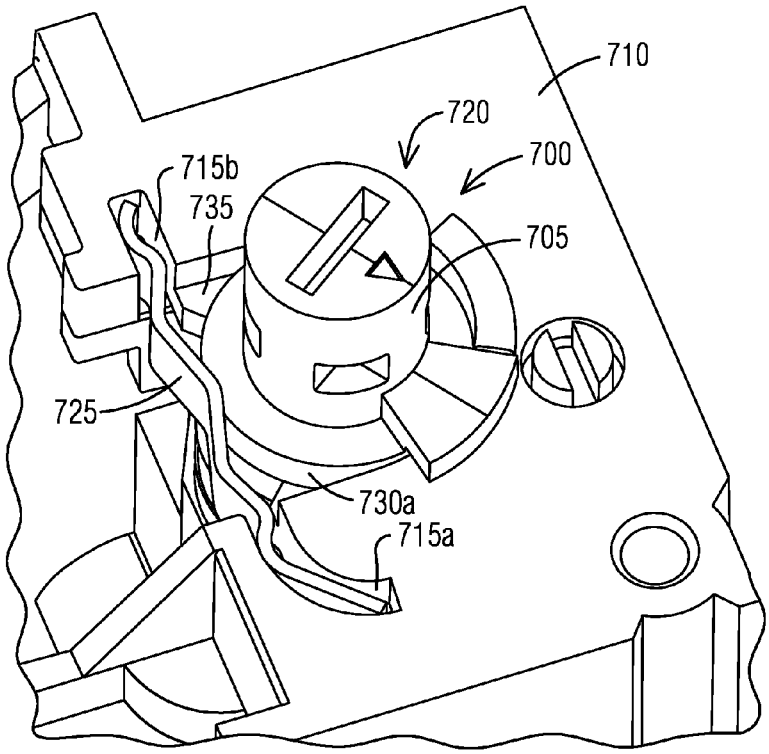
FIG. 7 illustrates an isometric view of a yet another alternate configuration of a friction adjustment control system for a rotary knob in accordance with an exemplary embodiment of the present invention.

In FIG. 7, an isometric view of a yet another alternate configuration of a friction adjustment control system 700 for a first rotary knob 705 is depicted in accordance with an exemplary embodiment of the present invention. A trip unit includes an internal support 710 having a first pair of slots 715*a*, 715*b*. The friction adjustment control system 700 includes a first knob control 720 of the first rotary knob 705. The first knob control 720 includes a first spring 725 installed in the first pair of slots 715*a*, 715*b* to apply a force directly against one or more first smooth rings 730*a* of the first rotary knob 705.

The first spring 725 may be an asymmetrical flat spring with a smooth perimeter. The one or more first smooth rings 730*a* have a shaped surface that provides control over a plurality of rotational positions of the first rotary knob 705 continuously by friction, force, and/or pressure adjustment. The first rotary knob 705 may be a magnetic knob of a molded case circuit breaker (MCCB). The trip unit may be a thermal magnetic trip unit of a molded case circuit breaker (MCCB).

A first opening 735 of the internal support 710 is configured to slidingly receive the first rotary knob 705 into position through the first opening 735. The first spring 725 is a flat spring configured for continuous operation.

Figure 8:
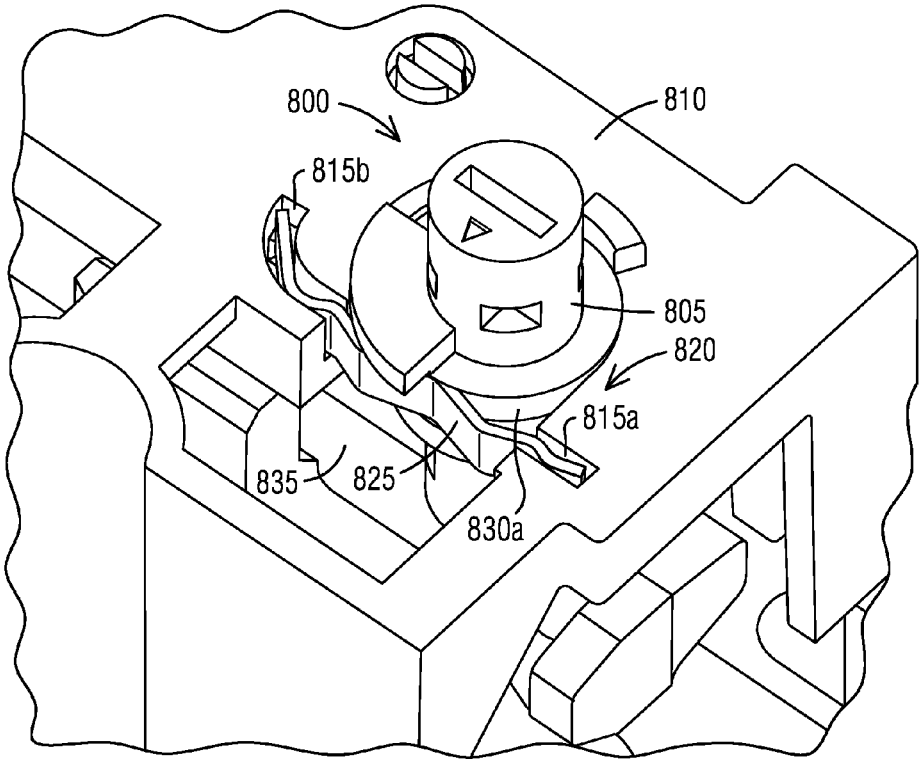
FIG. 8 illustrates an isometric view of a yet another alternate configuration of a friction adjustment control system with an asymmetrical flat spring for a rotary knob in accordance with an exemplary embodiment of the present invention.

With regard to FIG. 8, it also illustrates an isometric view of a yet another alternate configuration of a friction adjustment control system 800 with an asymmetrical flat spring for a second rotary knob 805 in accordance with an exemplary embodiment of the present invention. A trip unit includes an internal support 810 having a second pair of slots 815*a*, 815*b*. The friction adjustment control system 800 includes a second knob control 820 of the second rotary knob 805. The second rotary knob 805 includes a second spring 825, e.g., the asymmetrical flat spring installed in the second pair of slots 815*a*, 815*b* to apply a force directly against one or more second smooth rings 830*a* of the second rotary knob 805.

The second spring 825 may be an asymmetrical flat spring with a smooth perimeter. The one or more second smooth rings 830*a* have a shaped surface that provides control over a plurality of rotational positions of the second rotary knob 805 continuously by friction, force, and/or pressure adjustment. The second rotary knob 805 may be a thermal knob of a molded case circuit breaker (MCCB). The trip unit may be a thermal magnetic trip unit of a molded case circuit breaker (MCCB)

A second opening 835 of the internal support 810 is configured to slidingly receive the second rotary knob 805 into position through the second opening 835. The second spring 825 is a flat spring configured for continuous operation.

Figure 9:
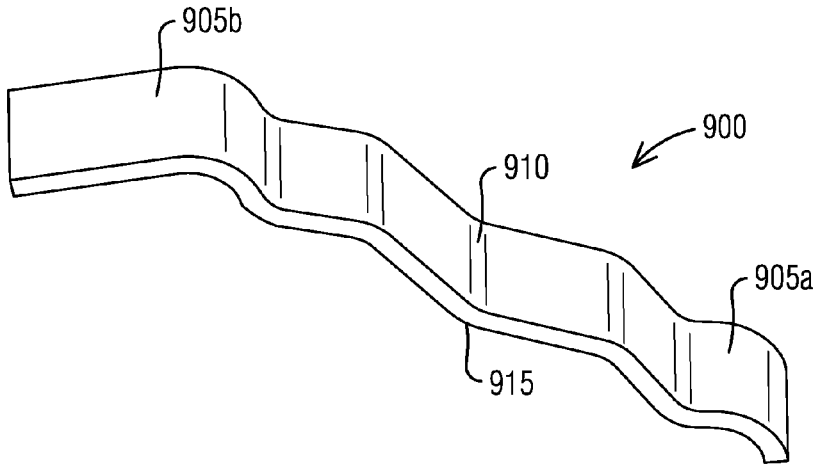
FIG. 9 illustrates an isometric view of an asymmetrical flat spring for use in a friction adjustment control system of a rotary knob in accordance with an exemplary embodiment of the present invention.

With respect to FIG. 9, it illustrates an isometric view of an asymmetrical flat spring 900 for use in a friction adjustment control system of a rotary knob in accordance with an exemplary embodiment of the present invention. The asymmetrical flat spring 900 having two sides or halves that don't match at least because they are not the same in shape, size, and/or arrangement. In particular, the asymmetrical flat spring 900 has a first leaf end 905*a* and a second leaf end 905*b* such that the length of the second leaf end 905*b* is larger than the length of the first leaf end 905*a*. Also, the second leaf end 905*b* has a different shape than the first leaf end 905*a* as they don't mirror each other physically.

The first pair of slots 715*a*, 715*b* and the second pair of slots 815*a*, 815*b* are configured such that they receive the first leaf end 905*a* and the second leaf end 905*b* completely within the slot opening. The first leaf end 905*a* and the second leaf end 905*b* are curved in a shape such that the first pair of slots 715*a*, 715*b* or the second pair of slots 815*a*, 815*b* holds the asymmetrical flat spring 900 in position frictionally.

The asymmetrical flat spring 900 having a central portion 910 curved to form a tip 915 that frictionally engages with the one or more first smooth rings 730*a* or the one or more second smooth rings 830*a* to directly apply a spring force onto the first rotary knob 705 or the second rotary knob 805, respectively.

Figure 10:
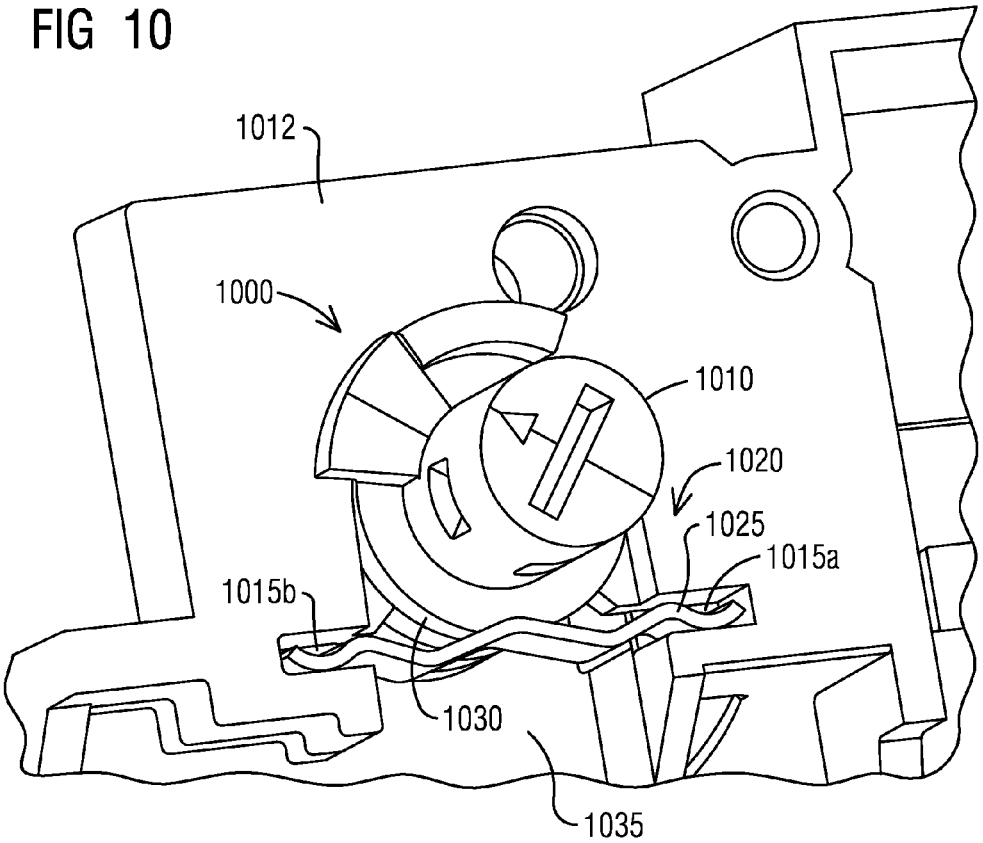
FIG. 10 illustrates an isometric view of a yet another alternate configuration of a friction adjustment control system with a symmetrical flat spring for a rotary knob in accordance with an exemplary embodiment of the present invention.

In accordance with an exemplary embodiment of the present invention, FIG. 10 illustrates an isometric view of a yet another alternate configuration of a friction adjustment control system 1000 with a symmetrical flat spring for a rotary knob 1010. A trip unit includes an internal support 1012 having a pair of slots 1015*a*, 1015*b*. The friction adjustment control system 1000 includes a knob control 1020 of the rotary knob 1010. The knob control 1020 includes a spring 1025 installed in the pair of slots 1015*a*, 1015*b* to apply a force directly against one or more smooth rings 1030 of the rotary knob 1010.

The spring 1025 may be a symmetrical flat spring with a smooth perimeter. The one or more smooth rings 1030 have a shaped surface that provides control over a plurality of rotational positions of the rotary knob 1010 continuously by friction, force, and/or pressure adjustment. The rotary knob 1010 may be a thermal knob or a magnetic knob of a molded case circuit breaker (MCCB). The trip unit may be a thermal magnetic trip unit of a molded case circuit breaker (MCCB)

An opening 1035 of the internal support 1012 is configured to slidingly receive the rotary knob 1010 into position through the opening 1035. The spring 1025 is a flat spring configured for continuous operation.

FIG. 11 illustrates an isometric view of a symmetrical flat spring 1100 for use in a friction adjustment control system of a rotary knob in accordance with an exemplary embodiment of the present invention. The symmetrical flat spring 1100 having two sides or halves that match at least because they are the same in shape, size, and/or arrangement. In particular, the symmetrical flat spring 1100 has a first leaf end 1105*a* and a second leaf end 1105*b* such that the length of the second leaf end 1105*b* is same as the length of the first leaf end 1105*a*. Also, the second leaf end 1105*b* has an identical shape as the first leaf end 1105*a* since they mirror each other physically.

The symmetrical flat spring 1100 having a central portion 1110 curved to form a tip 1115 that frictionally engages with the one or more smooth rings 1030 to directly apply a spring force onto the rotary knob 1010.

Examples of a flat spring include the symmetrical flat spring 1100. The symmetrical flat spring 1100 may be made of music wire, zinc plated music wire or a stainless steel. The symmetrical flat spring 1100 thickness may range from 0.5 mm to over 0.8 mm. The symmetrical flat spring 1100 width may range from 1.5 mm to over 4 mm. The symmetrical flat spring 1100 force may range from 15N to over 50N.

FIG. 12 illustrates a flow chart of a method 1200 of controlling rotational positions of knobs in a thermal magnetic trip unit of the circuit breaker 10 of FIG. 1 in accordance with an exemplary embodiment of the present invention. Reference is made to the elements and features described in FIGS. 1-11. It should be appreciated that some steps are not required to be performed in any particular order, and that some steps are optional.

At step 1205, the method 1200 includes providing a first opening in an internal support of a trip unit to receive a first rotary knob having one or more first smooth rings. In step 1210, the method 1200 further includes providing a second opening in the internal support to receive a second rotary knob having one or more second smooth rings.

A first knob control of the first rotary knob is provided in step 1215. The first knob control includes a first structural support, a first housing and a first spring installed in the first housing against the first structural support. Likewise, a second knob control of the second rotary knob is provided in step 1220. The second knob control includes a second structural support, a second housing and a second spring installed in the second housing against the second structural support.

The method 1200 further includes in step 1225 applying a first force onto the first housing such that the first housing pushes directly against the one or more first smooth rings of the first rotary knob to provide control over a plurality of rotational positions of the first rotary knob by friction, force, and/or pressure adjustment. Finally, the method 1200 includes in step 1230 applying a second force onto the second housing such that the second housing pushes directly against the one or more second smooth rings of the second rotary knob to provide control over a plurality of rotational positions of the second rotary knob by friction, force, and/or pressure adjustment.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A circuit breaker, comprising:

a trip unit including an internal support, the internal support including a first opening to receive a first rotary knob having one or more first smooth rings and a second opening to receive a second rotary knob having one or more second smooth rings;

a first knob control of the first rotary knob, the first knob control including a first structural support, a first housing and a first spring installed in the first housing against the first structural support to apply a force onto the first housing such that the first housing presses directly against the one or more first smooth rings of the first rotary knob; and a second knob control of the second rotary knob, the second knob control including a second structural support, a second housing and a second spring installed in the second housing against the second structural support to apply a force onto the second housing such that the second housing presses directly against the one or more second smooth rings of the second rotary knob.

2. The circuit breaker of claim 1, wherein the one or more first smooth rings having a shaped surface that provides control over a plurality of rotational positions of the first rotary knob continuously by at least one of friction, force, and pressure adjustment.

3. The circuit breaker of claim 2, wherein the one or more second smooth rings having a shaped surface that provides control over a plurality of rotational positions of the second rotary knob continuously by at least one of friction, force, and pressure adjustment.

4. The circuit breaker of claim 1, wherein the first opening of the internal support is configured to slidingly receive the first rotary knob into position through the first opening.

5. The circuit breaker of claim 4, wherein the second opening of the internal support is configured to slidingly receive the second rotary knob into position through the second opening.

6. The circuit breaker of claim 1, wherein the first rotary knob is a magnetic knob of a molded case circuit breaker (MCCB).

7. The circuit breaker of claim 1, wherein the second rotary knob is a thermal knob of a molded case circuit breaker (MCCB).

8. The circuit breaker of claim 1, wherein the trip unit is a thermal magnetic trip unit of a molded case circuit breaker (MCCB).

9. The circuit breaker of claim 1, wherein the first spring is a coiled spring and the second spring is a coiled spring.

10. A circuit breaker, comprising:

a trip unit including an internal support, the internal support including a first opening to receive a first rotary knob having one or more first smooth rings, a second opening to receive a second rotary knob having one or more second smooth rings, a first pair of slots and a second pair of slots;

a first knob control of the first rotary knob, the first knob control including a first spring installed in the first pair of slots to apply a force directly against the one or more first smooth rings of the first rotary knob; and a second knob control of the second rotary knob, the second knob control including a second spring installed in the second pair of slots to apply a force directly against the one or more second smooth rings of the second rotary knob.

11. The circuit breaker of claim 10, wherein the one or more first smooth rings having a shaped surface that provides control over a plurality of rotational positions of the first rotary knob continuously by at least one of friction, force, and pressure adjustment.

12. The circuit breaker of claim 11, wherein the one or more second smooth rings having a shaped surface that provides control over a plurality of rotational positions of the second rotary knob continuously by at least one of friction, force, and pressure adjustment.

13. The circuit breaker of claim 10, wherein the first rotary knob is a magnetic knob of a molded case circuit breaker (MCCB) and the second rotary knob is a thermal knob of the molded case circuit breaker (MCCB).

14. The circuit breaker of claim 10, wherein the trip unit is a thermal magnetic trip unit of a molded case circuit breaker (MCCB).

15. The circuit breaker of claim 10, wherein the first opening of the internal support is configured to slidingly receive the first rotary knob into position through the first opening and the second opening of the internal support is configured to slidingly receive the second rotary knob into position through the second opening.

16. The circuit breaker of claim 10, wherein the first spring is a flat spring configured for continuous operation and the second spring is a flat spring configured for continuous operation.

17. A method of controlling rotational positions of knobs in a thermal magnetic trip unit of a circuit breaker, the method comprising:

providing a first opening in an internal support of a trip unit to receive a first rotary knob having one or more first smooth rings;

providing a second opening in the internal support to receive a second rotary knob having one or more second smooth rings;

providing a first knob control of the first rotary knob, the first knob control including a first structural support, a first housing and a first spring installed in the first housing against the first structural support;

providing a second knob control of the second rotary knob, the second knob control including a second structural support, a second housing and a second spring installed in the second housing against the second structural support;

applying a first force onto the first housing such that the first housing pushes directly against the one or more first smooth rings of the first rotary knob to provide control over a plurality of rotational positions of the first rotary knob by at least one of friction, force, and pressure adjustment; and applying a second force onto the second housing such that the second housing pushes directly against the one or more second smooth rings of the second rotary knob to provide control over a plurality of rotational positions of the second rotary knob by at least one of friction, force, and pressure adjustment.

18. The method of claim 17, wherein the first rotary knob is a magnetic knob of a molded case circuit breaker (MCCB) and the second rotary knob is a thermal knob of the molded case circuit breaker (MCCB) and wherein the trip unit is a thermal magnetic trip unit of the molded case circuit breaker (MCCB).

19. The method of claim 18, wherein the first opening of the internal support is configured to slidingly receive the first rotary knob into position through the first opening and the second opening of the internal support is configured to slidingly receive the second rotary knob into position through the second opening.

20. The method of claim 19, wherein the first spring is a coiled spring and the second spring is a coiled spring.

* * * * *